US006622609B1

(12) United States Patent
Barkan

(10) Patent No.: US 6,622,609 B1
(45) Date of Patent: Sep. 23, 2003

(54) BREECH MECHANISM WITH NON-ROTATING BREECHBLOCK

(75) Inventor: Shai Barkan, Tel Aviv (IL)

(73) Assignee: Spearfire Ltd., Tel Aviv (IL)

( * ) Notice: Subject to any disclaimer, the term of this patent is extended or adjusted under 35 U.S.C. 154(b) by 0 days.

(21) Appl. No.: 10/299,664

(22) Filed: Nov. 20, 2002

Related U.S. Application Data

(60) Provisional application No. 60/390,434, filed on Jun. 24, 2002.

(51) Int. Cl.[7] ..... F41A 3/00

(52) U.S. Cl. ..... 89/180; 89/181; 89/187.01; 89/196; 42/16

(58) Field of Search ..... 89/180, 181, 187.01, 89/187.02, 194, 196; 42/16, 17, 18, 19

(56) References Cited

U.S. PATENT DOCUMENTS 3,566,745 A * 3/1971 Jauch et al. ..... 89/187.02
3,793,922 A * 2/1974 Angell et al. ..... 89/180
4,461,203 A * 7/1984 Jawdat ..... 89/154
5,259,137 A * 11/1993 Blenk et al. ..... 42/16
5,682,007 A * 10/1997 Dobbins ..... 89/187.02
5,900,576 A * 5/1999 Gabriel ..... 89/187.01

* cited by examiner

*Primary Examiner*—J. Woodrow Eldred
(74) *Attorney, Agent, or Firm*—Mark M. Friedman

(57) ABSTRACT

Disclosed is a breech mechanism with a non-rotating breechblock that is suitable for use with repeating firearms. The present invention is composed of relatively few moving parts, and each of the parts is itself simple, yet together they become an elegant solution to the problem providing a repeating firearm which minimizes damage the ballistic characteristics of the bullet as the bullet is inserted into the chamber of the firearm. The present invention, then, provides a repeating firearm substantially with the accuracy of a single shot manual loading firearm with a non-rotating breechblock.

19 Claims, 9 Drawing Sheets

BREECH MECHANISM WITH NON-ROTATING BREECHBLOCK

This application is based on U.S. Provisional Application No. 60/390434 filed Jun. 24, 2002.

FIELD AND BACKGROUND OF THE INVENTION

The present invention relates to breech mechanisms for firearms and, in particular, it concerns a breech mechanism with a non-rotating breechblock.

In theory, a plurality of ammunition projectiles, herein referred to as "bullets", all having identical ballistic characteristics, fired from the same stationary firearm would all hit the same target at the same point of impact. Manufacturing techniques today produce bullets with substantially identical ballistic characteristics. The ballistic characteristics of a bullet are affected by variances due to manufacturing tolerances and any alterations to the bullet after manufacture. The most common of these alterations are nicks and scratches to the surface of the bullet caused by the loading process of the particular firearm in which the bullet is used. In general, the "cartridge", herein used to refer to the combined bullet and bullet casing, is held in the chamber by a breechblock that rotates into a locked position. This rotating motion of the breechblock causes rotation of the cartridge which may cause the aforementioned nicks and scratches as the bullet is moved into the chamber and rubs against the lands and grooves of the rifling. These alterations, alone or in combination with alterations to the firearm due to ware, affect the accuracy by causing the bullets to hit the target in what is called in the art "a grouping". The spread of a grouping is characteristic to each firearm, and varies with the distance to the target.

To avoid this problem, some shooters use single shot, manual loading firearms with non-rotating breechblocks. This is effective in reducing the nicks and scratches and the grouping characteristic of these firearms approach the point of being affected solely by the stability and characteristics of the firearm itself.

There are, however, situations where a single shot, firearm is inappropriate or undesirable, and a highly accurate repeating firearm is necessary. At present, what is referred to in the art as a "bolt action" is the preferred repeating breech mechanism for those shooters who wish to attain high levels of accuracy in a repeating firearm.

The bolt action breech mechanism for a firearm especially a repeater weapon disclosed in U.S. Pat. No. 5,259,137 to Blenk et al. includes a non-rotating breechblock. The mechanism is, however, complex in both manufacture and maintenance. Further, the breechblock is locked in place by forcing normally closed locking fingers into an open position that locks the breechblock in a firing position.

Another problem of breech mechanisms of prior art is that of "head space". That is the distance from the surface of the breechblock that engages the rear of the bullet casing or cartridge forward to point at which the curvature of the bullet disengages the inside surface of the barrel. Optimally, the forward point of disengagement is contiguous to the rearward end of the lands of the barrel rifling. Deployment of the bullet in the chamber is determined by the position of the breechblock. The breechblock locking mechanisms of prior art utilize moving locking elements that are forced against, either rotationally or laterally, stationary members so as to push or draw the breechblock into a locked position. This may cause friction and thereby abrade the abutting surfaces. This may result in inaccurate deployment of the breechblock and therefore affect the head space such that the bullet is not deployed at the position in the chamber, either too far in or too far out.

There is therefore a need for a breech mechanism that provides a non-rotating breechblock that is locked in position with minimal abrasion of locking element such that head space in minimally affected, which is suitable for use with repeating firearms, and that is simple and easy to manufacture and maintain.

SUMMARY OF THE INVENTION

The present invention is The present invention is a breech mechanism that provides a non-rotating breechblock that is suitable for use with repeating firearms.

According to the teachings of the present invention there is provided, a breech mechanism for use in a firearm, the breech mechanism comprising: (a) a breech housing; (b) a slidingly displaceable breechblock at least partially deployed within the breech housing, the breechblock being displaceable between a firing position, and an ejecting and loading position, the breechblock terminating at a first end configured to interact with a bullet cartridge; and (c) a spring locking-element at least partially deployed within the breech housing, the spring locking-element configured so as to be biased to a normally locking state, the spring locking-element further configured such that as the breechblock is displaced from the ejecting and loading position toward the firing position is deformed out of the normally locking state, and as the breechblock reaches the firing position the spring locking-element springs back toward the normally closed state thereby locking the breechblock in the firing position.

According to a further teaching of the present invention, there is also provided, a releasing element at least partially deployed within the breech housing, the releasing element configured so as to deform the spring locking-element from the normally closed state thereby releasing the breechblock from the firing position.

According to a further teaching of the present invention, the breech housing is configured so as to hold the spring locking-element in a longitudinally static deployment.

According to a further teaching of the present invention, the spring locking-element is configured such that the normally locking state is an inwardly convergent closed state.

According to a further teaching of the present invention, the releasing element is configured so as to be slidingly displaceable and is deployed so as to circumscribe at least a portion of the breechblock, the releasing element being displaceable between non-releasing and releasing positions such that when the releasing element is displaced to the releasing position, the releasing element engages the spring locking-element thereby causing the radial expansion of the spring locking-element.

According to a further teaching of the present invention, the spring locking-element is configured substantially as a sleeve deployed within the breech housing, the locking element being configured such that the deformation from the normally closed state is implemented as substantially radial expansion of the locking element.

According to a further teaching of the present invention, the substantially radial expansion is at an end of the locking element that comes into contact with the breechblock such that as the breechblock is displaced from the ejecting and loading position toward the firing position, the breechblock causes the substantially radial expansion of the spring locking-element thereby allowing the breechblock to enter the spring locking-element such that the spring locking-element substantially circumscribes the breechblock, and as the breechblock reaches the firing position the spring locking-element springs back into the normally closed state thereby engaging the breechblock so as to lock the breechblock in the firing position.

According to a further teaching of the present invention, the spring locking-element is configured with a plurality of longitudinal slots along a portion of a length of the spring locking-element, the slots thereby defining between them, locking fingers that are connected to the spring locking-element at a first end, and free to spread substantially radially at a second end of the spring locking-element.

According to a further teaching of the present invention, there is also provided, engagement faces of the locking fingers configured at the second end of the spring locking-element, the engagement faces being configured such that as the breechblock is displaced from the ejecting and loading position toward the firing position, the breechblock engages the engagement faces thereby causing the locking fingers to spread radially so as to allow the breechblock to enter the spring locking-element such that the spring locking-element substantially circumscribes at least a portion of the breechblock.

According to a further teaching of the present invention, the engagement faces form an interior surface of the spring locking-element, the engagement faces being configured so as to be inwardly convergent.

According to a further teaching of the present invention, there is also provided, a locking ridge deployed on the locking fingers, the locking ridge configured so as to engage the breechblock.

According to a further teaching of the present invention, the breechblock is configured with the first end having a substantially radially enlarged portion, the enlarged portion terminating at the first end of the breechblock, the enlarged portion terminating at a second end in a locking shoulder, the locking shoulder configured to interlock with the locking ridge.

According to a further teaching of the present invention, the locking shoulder substantially circumscribes the breechblock.

According to a further teaching of the present invention, the releasing element is deployed so as to circumscribe at least a portion of a non-enlarged portion of the breechblock, the releasing element having an outside diameter at least equal to the outside diameter of the enlarged portion of the breechblock, the releasing element being displaceable in a direction substantially parallel to a length of the breechblock, the releasing element being displaceable between locking and releasing positions such that when the releasing element is displaced to the releasing position, the releasing element engages the engagement faces of the locking fingers thereby spreading the locking fingers radially so as to allow the displacement of the breechblock.

According to a further teaching of the present invention, the breechblock is configured so as to be non-rotating.

According to a further teaching of the present invention, the breechblock, the spring locking-element, and the releasing element are substantially cylindrical.

According to a further teaching of the present invention,sa longitudinal position of the spring locking-element within the breech housing is variable.

According to a further teaching of the present invention, the position of the spring locking-element is varied by at least one spacer deployed adjacent to at least one end of the spring locking-element.

According to a further teaching of the present invention, the displacement of the releasing element is actuated by rotation of a breechblock handle located adjacent to a second end of the breechblock.

According to a further teaching of the present invention, an axis of the rotation of the breechblock handle is substantially perpendicular to a line of displacement of the breechblock.

According to a further teaching of the present invention, a vector of displacement of the breechblock from the firing position to the ejection and loading position is parallel to a plane of rotation of the breechblock handle is parallel, such that the force applied to the handle rotates the handle thereby releasing the breechblock and the force then actuates the displacement of the breechblock.

According to a further teaching of the present invention, the spring locking-element is configured so as to define head space of the firearm.

BRIEF DESCRIPTION OF THE DRAWINGS

The invention is herein described, by way of example only, with reference to the accompanying drawings, wherein.

all of the accompanying drawing are intended to be schematic and no relationship based on scale is intended.

DESCRIPTION OF THE PREFERRED EMBODIMENTS

The present invention is a breech mechanism that provides a non-rotating breechblock that is suitable for use with repeating firearms.

The principles and operation of a breech mechanism with a non-rotating breechblock according to the present invention may be better understood with reference to the drawings and the accompanying description.

By way of introduction, two principle intentions of the present invention are to: 1) provide a mechanism for the successive placement of a plurality of live ammunition cartridges into the chamber of a firearm, substantially without rotating the cartridge, thereby minimizing damage to the bullet that will alter the ballistic characteristics of the bullet, discharge the round, and eject the spent cartridge; and 2) provide such a mechanism that is easily manufactured and maintained. As mentioned above, one of the most common sources of damage to bullets that alters their ballistic characteristics is due to the rotation of the bullet within the chamber end of the firearm barrel, therefore the present invention provides a non-rotating breechblock. It should be noted that while the discussion herein is directed to a manually operated bolt-action breech mechanism, the principles of the present invention may be adapted for use in, and provide benefit for, firearms with automatic and semi-automatic breech mechanisms. Further, the firing mechanism (i.e. firing pin and associated mechanism), and the spend cartridge ejector may be of any such mechanisms known in the art. It should be further noted that the principles of the present invention are equally applicable across the full range of ammunition calibers and are inclusive of center fire and rim fire ammunition. While the discussion herein is directed toward application of the present invention to a rifle, the principles of the present invention may be readily adapted for use with handguns as well.

Figures 1, 1A:
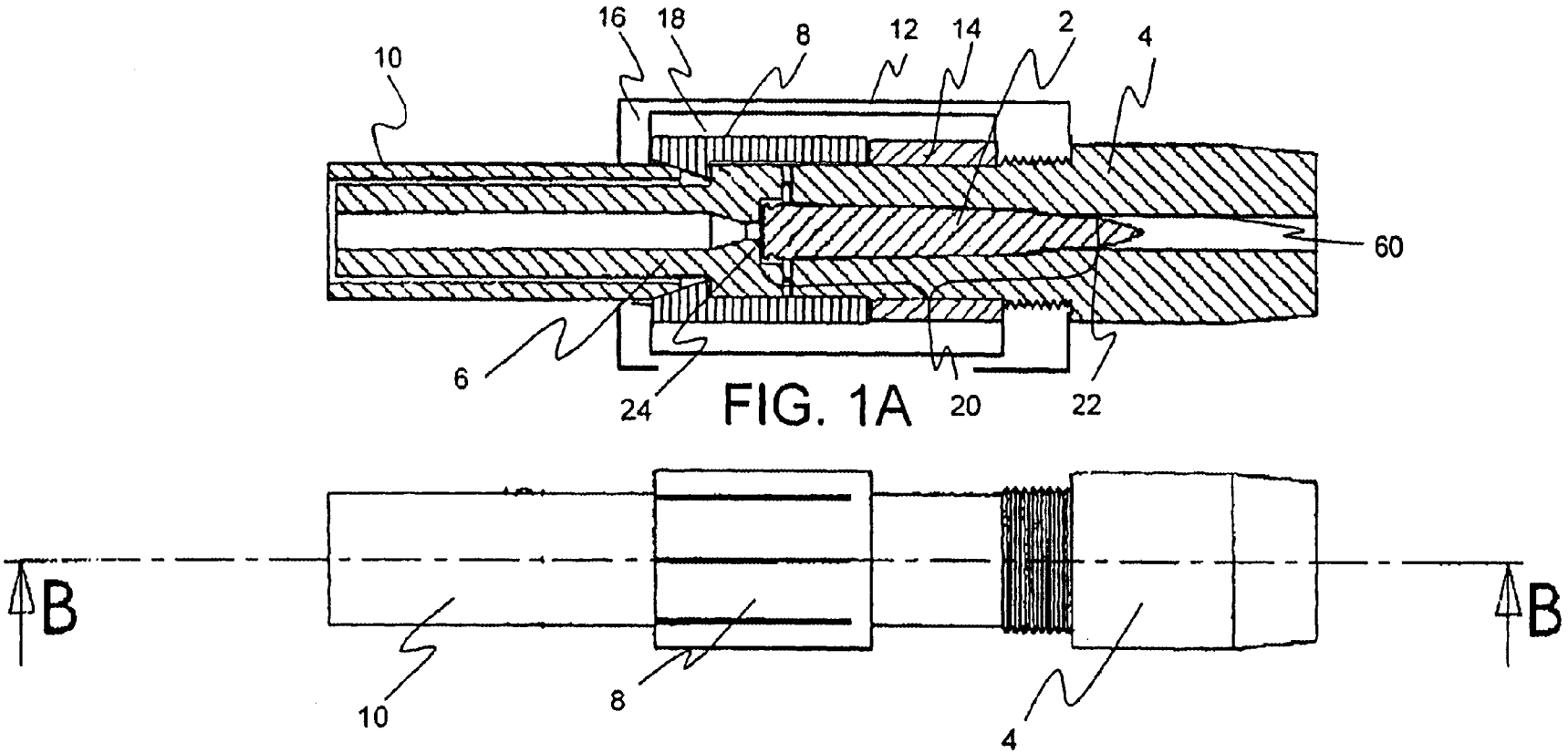
FIG. 1 is a schematic side elevation of a breech mechanism with a non-rotating breechblock constructed and operative according to the teachings of the present invention, shown here with the breechblock in a locked state.
FIG. 1A is a schematic cross-sectional view of FIG. 1 taken along line B.
Figure 2B:
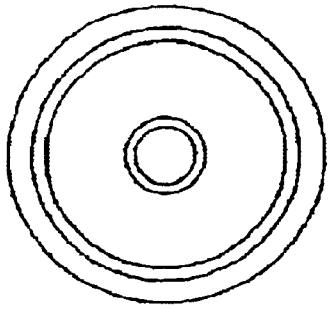
FIG. 2B is a schematic end elevation of FIG. 2.
Figure 2:
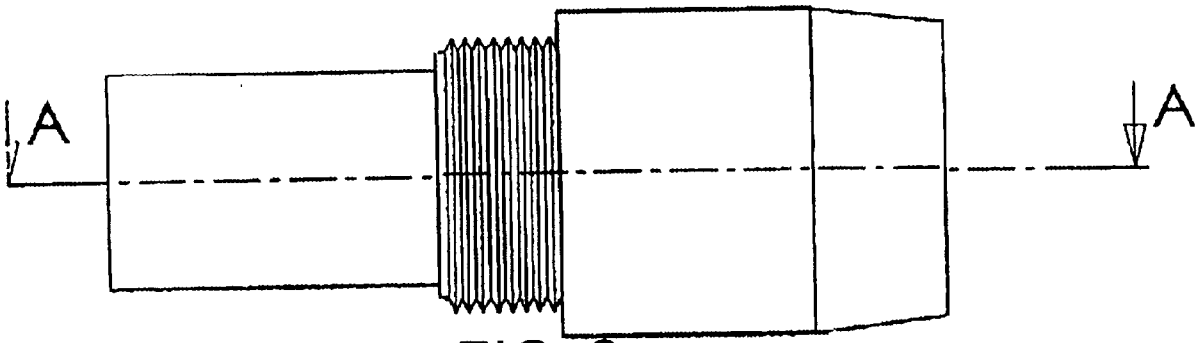
FIG. 2 is a schematic side elevation of a chamber end of a firearm barrel.
Figure 2A:
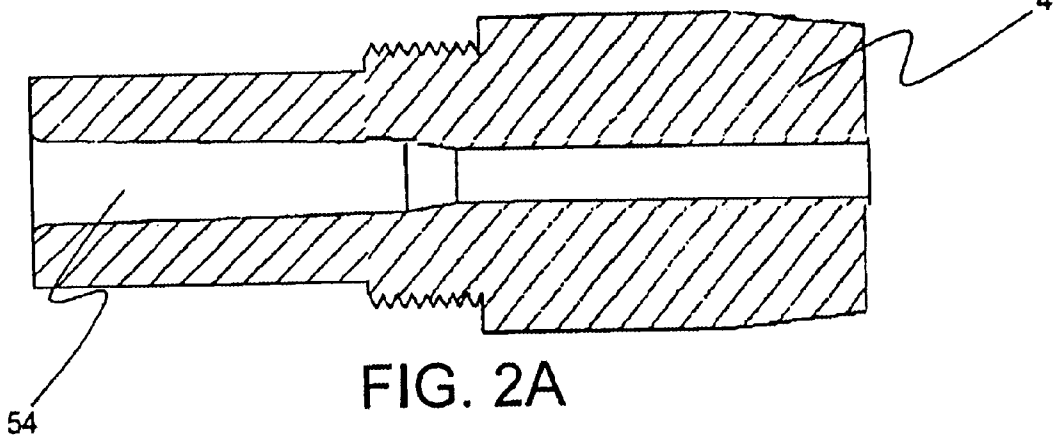
FIG. 2A is a schematic cross-sectional view of FIG. 2 taken along line A.

Referring now to the drawings, FIGS. 1 and 1A show a preferred embodiment of the breech mechanism of the present invention with the breechblock locked in a firing position. As with all breech mechanisms, the breechblock of the present invention is displaceable between a firing position and an ejecting and loading position. The ammunition cartridge 2 is held in place in the chamber (FIG. 2A 54) by the breechblock 6, which in turn is locked in place by the breechblock spring locking-element 8, which is a primary innovation of the present invention. Since the breechblock, and thus the cartridge, does not rotate as the cartridge is moved onto the chamber, the bullet is substantially undamaged by the lands of the rifling in the barrel.

Figure 3B:
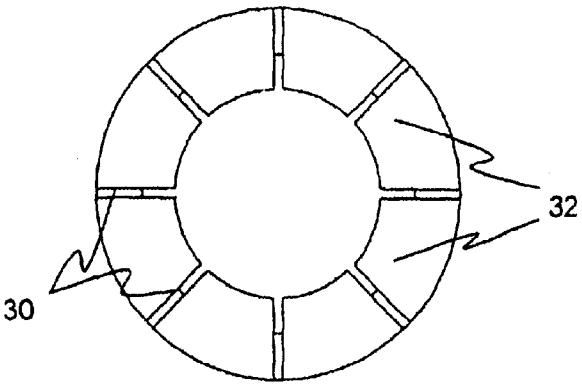
FIG. 3B is a schematic end elevation of FIG. 3.
Figure 3:
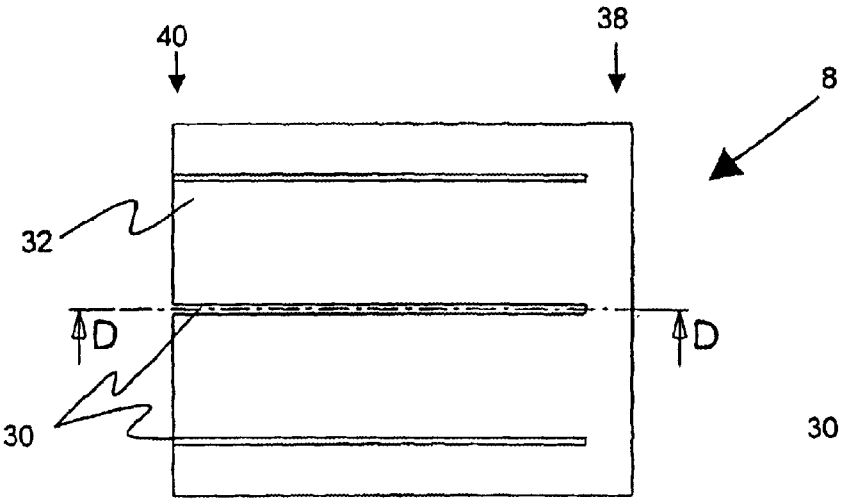
FIG. 3 is a schematic side elevation of a breechblock locking element constructed and operative according to the teachings of the present invention.
Figure 3A:
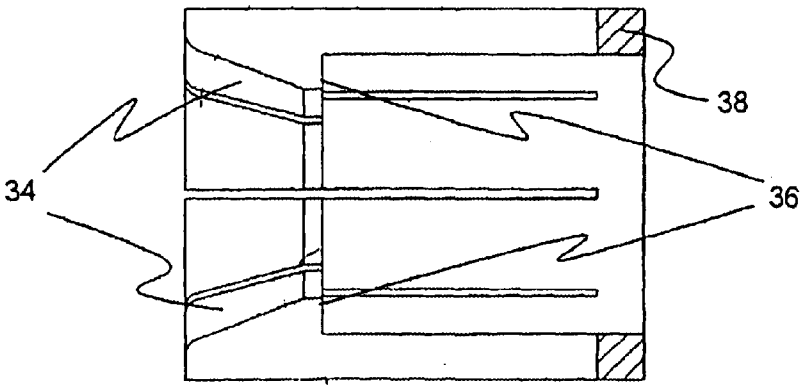
FIG. 3A is a schematic cross-sectional view of FIG. 3 taken along line D.
Figure 4B:
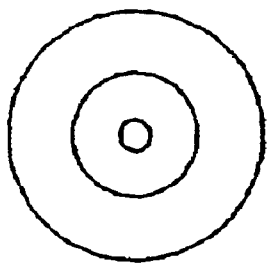
FIG. 4B is a schematic end elevation of FIG. 4.
Figure 4:
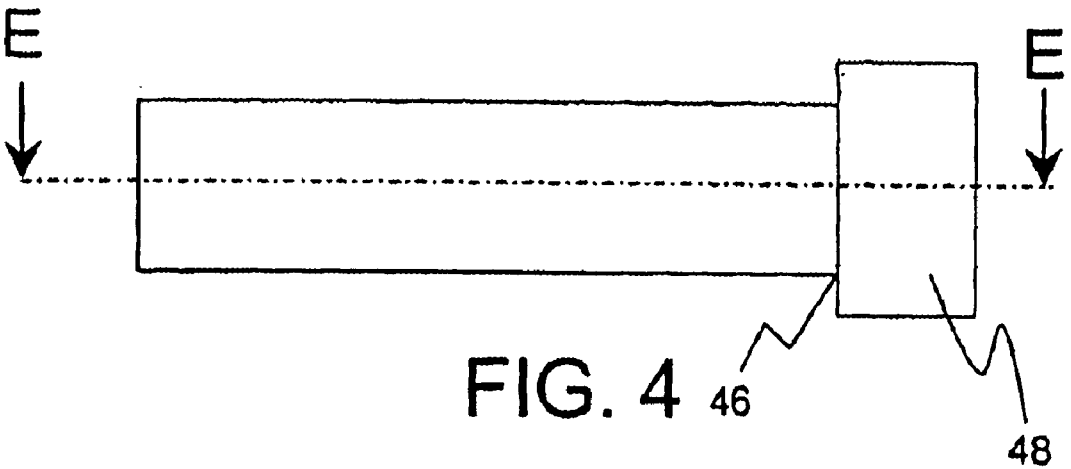
FIG. 4 is a schematic side elevation of a non-rotating breechblock constructed and operative according to the teachings of the present invention.
Figure 4A:
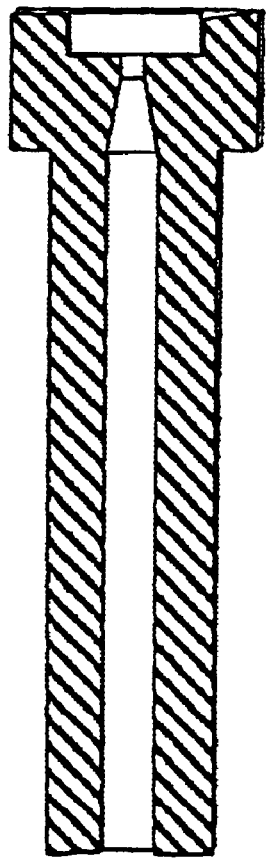
FIG. 4A is a schematic cross-sectional view of FIG. 4 taken along line E.

The preferred embodiment of a breechblock spring locking-element 8 illustrated in FIGS. 3, 3A, and 3B is a cylinder that has a plurality of longitudinal slots 30 along a portion of the length of the cylinder. Located between the slots are locking fingers 32 that are connected to the cylinder at one end, referred to herein as the "closed end" 38 and free to deform radially at the other end of the cylinder, referred to herein as the "open end" 40. The open end of the cylinder includes an annular ring, FIG. 3B, made up of the inwardly convergent engagement faces 34 of the locking fingers 32. Also included in the annular region is a locking ridge 36 that is configured to engage the locking shoulder (FIG. 4 number 46) of the cylindrical enlarged portion 48 of the breechblock 6. A portion of the breechblock spring locking-element 8 circumscribes the chamber end of the barrel 4 and is held in a longitudinally static deployment between the rear wall 16 of the breech housing 12 and the barrel 4, when the barrel is attached to the breech housing. The breech housing is configured so as to allow for the radial expansion of the spring locking-element element 8 within the space 18. The spacer 14 shown here, may optionally be deployed if necessary, or the spring locking-element 8 may be configured so as to span substantially the full distance between the rear wall 16 of the breech housing 12 and the barrel 4. It should be noted that the spring locking-element may be configured so as to radially expand along its entire length.

Figures 5, 5A:
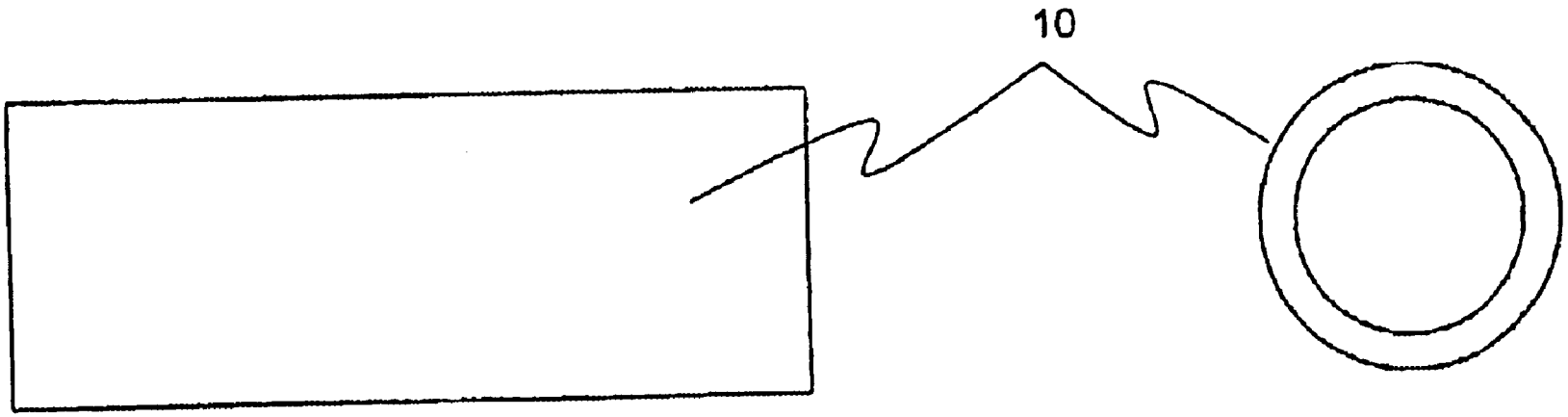
FIG. 5 is a schematic side elevation of a breechblock releasing element constructed and operative according to the teachings of the present invention.
FIG. 5A is a schematic end elevation of FIG. 5.

The preferred embodiment of a breechblock releasing element 10 illustrated in FIGS. 5 and 5B is a cylindrical tube with an outside diameter greater than or equal to the outside diameter of the enlarged portion 48 of the breechblock 6. The breechblock releasing element 10 circumscribes the breechblock 6 so as to slidingly engage the engagement faces 34 of the locking fingers 32 of the breechblock spring locking-element 8, radially deform the locking fingers, and allow the breechblock to slide rearward out of the breechblock spring locking-element 8. Thereafter, the breechblock 6 and the breechblock releasing element 10 are moved rearward so as to remove the spent cartridge form the chamber and eject it from the firearm. It should be noted that while the discussion herein is directed toward a cylindrical locking sleeve and releasing element, the lateral cross-sectional contour of both the locking-sleeve and releasing element may be of any appropriate shape corresponding to the shape of the breechblock. In such a case, the deformation would be a variant radial deformation away from the axis of the rifle bore.

The breech mechanism of the present invention may be used with a firearm barrel 4 (FIGS. 2, 2A, and 2B) that is available commercially or one that is custom made.

Figure 6A:
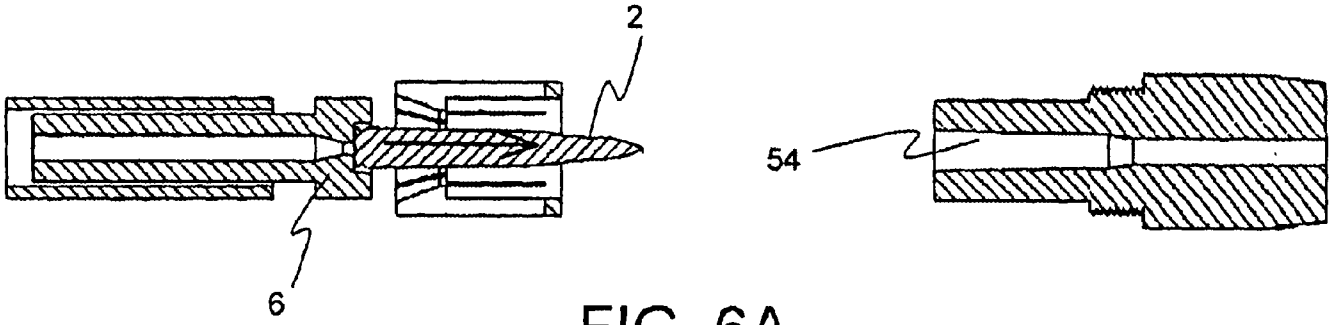
FIG. 6A is a schematic cross-sectional view of FIG. 6 taken along line A.
Figure 6:
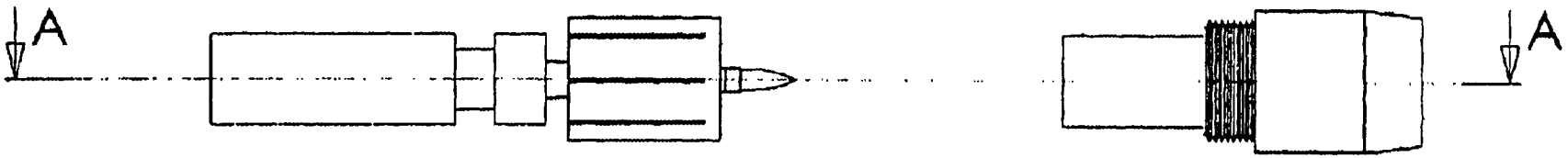
FIG. 6 is a schematic exploded side elevation a breech mechanism with a non-rotating breechblock of FIG. 1.
Figure 7B:
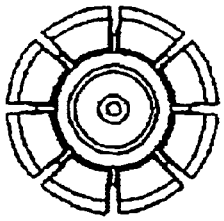
FIG. 7B is a schematic end elevation of FIG. 7.
Figure 7:
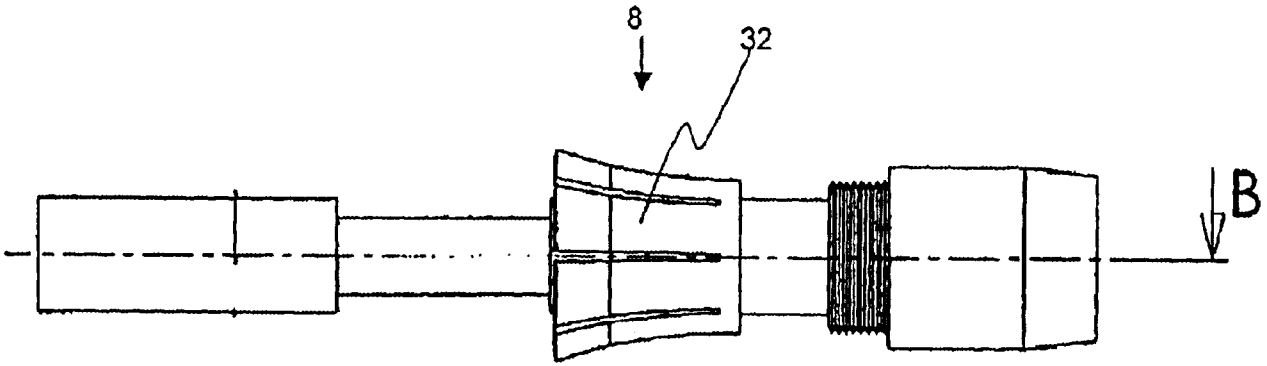
FIG. 7 is a schematic side elevation of the breechblock being inserted into the breechblock locking element.
Figure 7A:
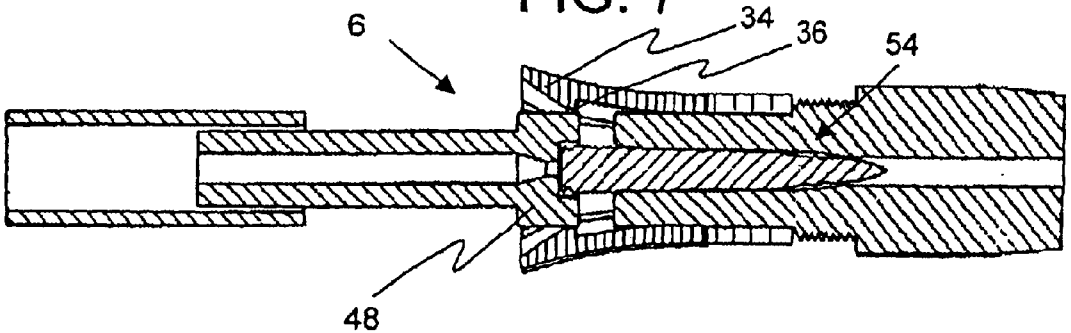
FIG. 7A is a schematic cross-sectional view of FIG. 7 taken along line B.
Figure 8A:
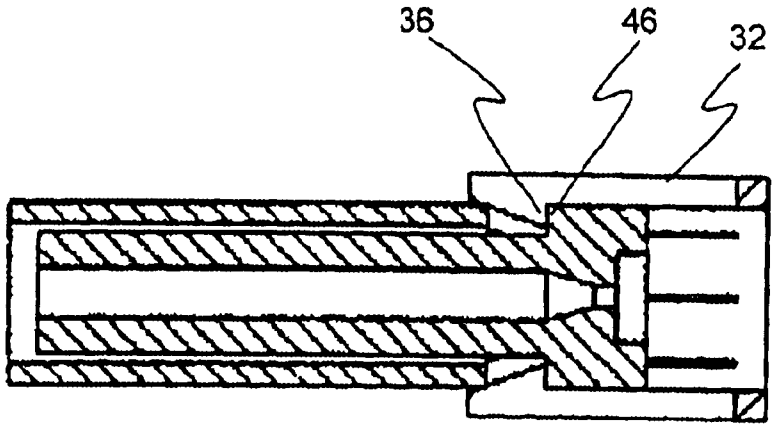
FIG. 8A is a schematic cross-sectional view of FIG. 8 taken along line B.
Figure 8:
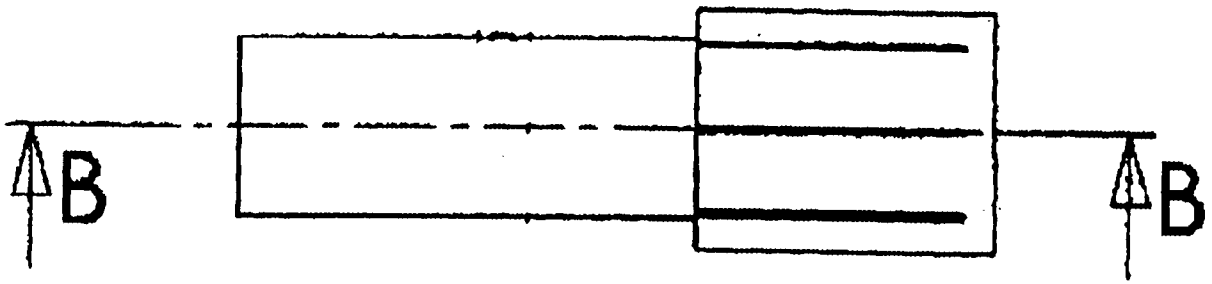
FIG. 8 is a schematic side elevation of the breechblock locked in place by the breechblock locking element.
Figure 8B:
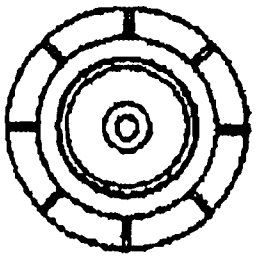
FIG. 8B is a schematic end elevation of FIG. 8.

To place a live cartridge 2 in the chamber 54, the cartridge 2 is pushed forward by the breechblock 6, as seen in the exploded view of FIGS. 6 and 6A. As the enlarged portion 48 of the breechblock comes into contact with the inwardly convergent engagement faces 34 of the locking fingers 32, the fingers are forced to deform radially (FIGS. 7, 7A, and 7B), thereby allowing the breechblock 6 and cartridge 2 to continue moving forward. The forward movement stops when the cartridge is fully inserted into the chamber 54, at which point the shoulder 46 of the enlarged portion 48 of the breechblock passes the locking ridge 36 of the locking fingers 32 thus allowing the locking fingers to, at least partially, return to their normally closed position thereby locking the breechblock 6 in place, as seen in FIGS. 1, 8, 8A, and 8B. It should be noted that the locking fingers do not forcibly draw the breechblock into the firing position, rather the breechblock is deployed by the force exerted on the breechblock by the user, and the locking fingers snap into the locking position with a minimal amount of friction and abrasion. Note, further, that at no point during the insertion process did the mechanism, hence the cartridge, rotate, thus the cartridge is chambered substantially without damage caused by rotation of the bullet that will affect the ballistic characteristics of the bullet, usually caused by the lands of the rifling against the rotating bullet as a breechblock of prior art is rotated into a locked position.

Figure 9:
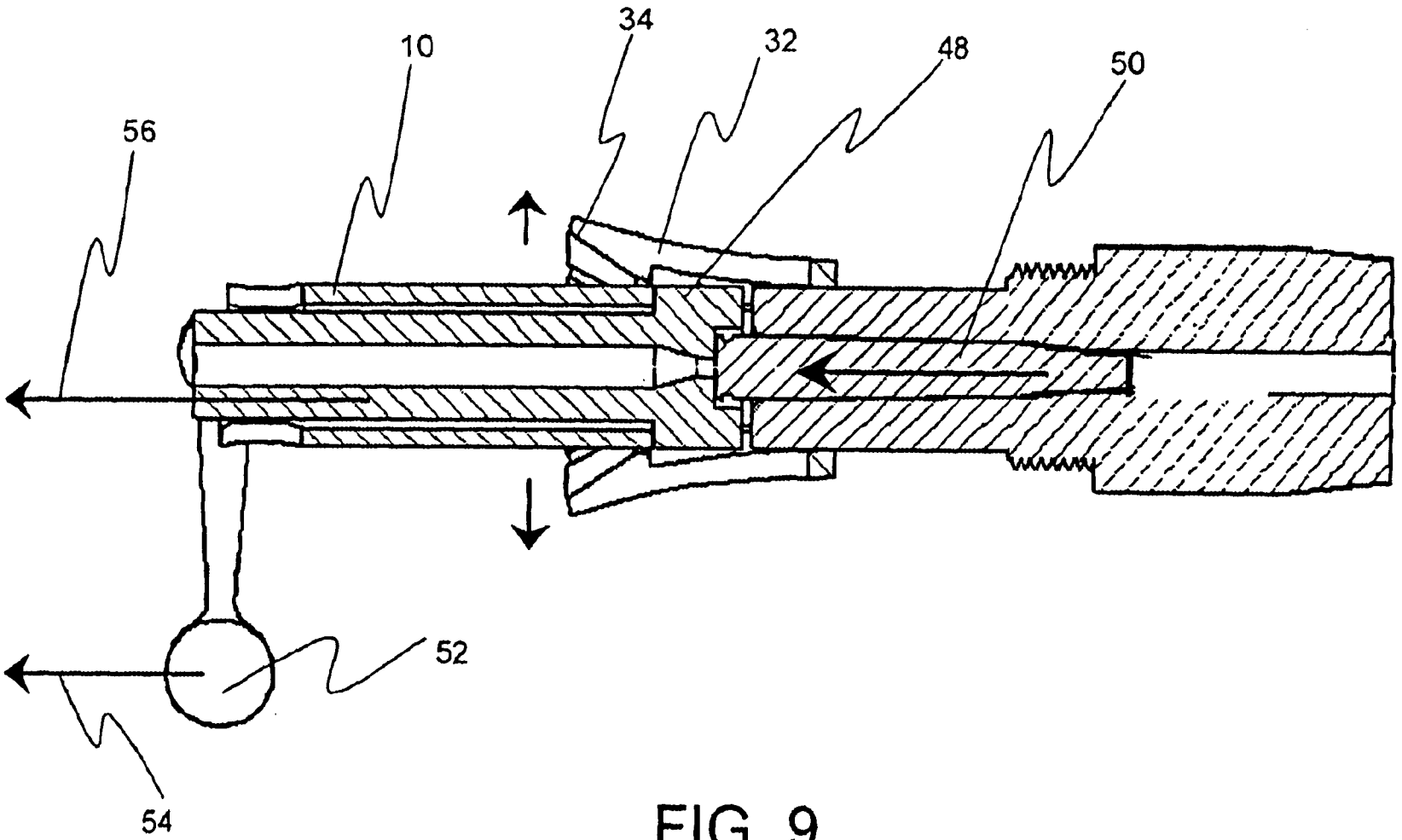
FIG. 9 is a schematic cross-sectional view of the breech mechanism, showing the releasing process.

As illustrated in FIG. 9, to unlock the breechblock 6 and remove the spent cartridge 50, the breechblock releasing element 10 is pushed forward so that it engages the engagement faces 34 of the locking fingers 32 thereby forcing the locking fingers to deform radially far enough to release the enlarged portion 48 of the breechblock 6. By non-limiting example, the breechblock releasing element is preferably moved forward by rotation of the bolt handle 52 about an axis that is perpendicular to the line of displacement of the breechblock. This results in a manual motion that is substantially parallel to the line of fire of the weapon. In the preferred embodiment illustrated here, the vector 54 of the force that initiates the rotation of the handle 52 is substantially parallel to and substantially co-directional with the vector 56 of force necessary to displace the breechblock from the firing position to the ejection and loading position. Thus aligned, force is applied to the handle 52 in order to rotate in, thereby bring the releasing element to an unlocking position and release the breechblock. Once the breechblock is released, substantially no change in the direction of the force is necessary to actuate displacement of the breechblock to the ejection and loading position.

It should be noted, that although the discussion herein relates to a breechblock with an enlarged portion that includes a locking shoulder, the breechblock may, by non-limiting example, alternatively be configured as a cylinder with a substantially constant diameter having either locking notches corresponding to the locking ridge portion of each finger of the spring locking-element or a locking groove that circumscribes the outer wall of the breechblock at an appropriate distance along the length of the breechblock so as to align with the locking ridge when the breechblock is in the firing position. In either case, the engagement faces of the locking fingers would extant above the breechblock high enough to be engaged by the releasing element.

Another innovation of the present invention concerns what is know in the art as "head space" 20. This is the distance from surface 24 of the breechblock that engages the rear of the cartridge 2 forward to the point 22 at which the curvature of the bullet disengages the inside surface 60 of the barrel 4. Unlike breechblock locking mechanisms of prior art that lock the breechblock in position by forcibly rotating or expanding movable locking elements against stationary locking elements, the locking fingers 32 do not snap back toward their normally locked position until the breechblock 6 is full deployed. That is, the breechblock 6 must be manually pushed forward, when it reaches the optimum deployment, the locking fingers 32 are free to spring into a locked deployment with minimal friction or abrasion, thus optimal head space is maintained for a longer period of time than with prior art locking mechanisms. Head space in the present invention is determined by the spring locking-element. The breechblock spring locking-element 8 and the spacer 14 are deployed around the chamber end of the barrel 4 which may be connected to the breech housing 12 by any means known in the art. The non-limiting example shown here is that of a barrel that is screwed into place. It will be readily apparent that the areas most prone to ware are the areas of contact between the breechblock spring locking-element and the rear wall of the breech housing, and the area of contact between the breechblock spring locking-element and the breechblock releasing element. It should be noted, however, that as per a principle intention of the present invention stated above, these two elements are intended to be inexpensive and easily replaced by one of even less than ordinary skill in the art, and in some applications may be accomplished "in the field." Further, any ware to the rear wall of the breech housing may be easily corrected by insertion of an inexpensive shim or spacer ring, which may be placed into the breech housing before insertion of the breechblock spring locking-element. Thereby enabling maintenance of optimal head space.

The rotational locking movement of conventional bolt action adds to the amount of time between shots, the firing cycle. That is the time necessary to eject a spent cartridge and place a live cartridge in the chamber. This cycle involves four movements, each of which is in a different direction; 1- rotate to unlock the breechblock, 2- rearward to eject the spent cartridge, 3- forward to insert the live cartridge, 4- rotate to lock the breechblock. Further, the two rotational movements are in directions that are perpendicular to the line of fire of the firearm.

The firing cycle of the present invention involves three steps, all of which are substantially parallel to the line of fire of the firearm. The movements are: 1- rotate bolt handle to push the breechblock releasing element forward and release the breechblock; 2- pull the breechblock rearward to eject the spent cartridge; 3- push the breechblock forward until the live cartridge is fully inserted into the chamber and the breechblock is locked in place by the breechblock spring locking element. Thus, the shooter may "chamber a round" without taking his/her eyes off of the target, and without performing any associated movements that are out of alignment with the line of fire that may affect the stability or line of fire of the firearm.

It will be appreciated by one ordinarily skilled in the art, that the breech mechanism of the present invention, as described above, is composed of relatively few moving parts, and that each of the parts is itself simple and may be produced inexpensively, yet together they become an elegant solution to the problem providing a repeating firearm which does not damage the ballistic characteristics of the bullet as the bullet is inserted into the chamber of the firearm by rotating the cartridge as the breechblock is locked in place. The present invention, then, provides a repeating firearm with substantially the accuracy of a single shot manual loading firearm with a non-rotating breechblock, which is easily maintained.

It will be appreciated that the above descriptions are intended only to serve as examples, and that many other embodiments are possible within the spirit and the scope of the present invention.

What is claimed is:

1. A breech mechanism for use in a firearm, the breech mechanism comprising:

(a) a breech housing;

(b) a slidingly displaceable breechblock at least partially deployed within said breech housing, said breechblock being displaceable between a firing position, and an ejecting and loading position, said breechblock terminating at a first end configured to interact with a bullet cartridge; and (c) a spring locking-element configured as a sleeve that is as at least partially deployed within said breech housing, said spring locking-element configured so as to be biased to a normally locking state, which is an inwardly convergent closed state, said spring locking-element further configured such that as said breechblock is displaced from said ejecting and loading position toward said firing position is deformed out of said normally locking state, and as said breechblock reaches said firing position said spring locking-element springs back toward said normally closed state thereby locking said breechblock in said firing position, wherein said deformation from said normally closed state is substantially radial expansion of said locking element.

2. The breech mechanism of claim 1, further including a releasing element at least partially deployed within said breech housing, said releasing element configured so as to deform said spring locking-element from said normally closed state thereby releasing said breechblock from said firing position, wherein said releasing element is configured so as to be slidingly displaceable and is deployed so as to circumscribe at least a portion of said breechblock, said releasing element being displaceable between non-releasing and releasing positions such that when said releasing element is displaced to said releasing position, said releasing element engages said spring locking-element thereby causing said radial expansion of said spring locking-element.

3. The breech mechanism of claim 2, wherein said breech housing is configured so as to hold said spring locking-element in a longitudinally static deployment.

4. The breech mechanism of claim 2, wherein said substantially radial expansion is at an end of said locking element that comes into contact with said breechblock such that as said breechblock is displaced from said ejecting and loading position toward said firing position, said breechblock causes said substantially radial expansion of said spring locking-element thereby allowing said breechblock to enter said spring locking-element such that said spring locking-element substantially circumscribes said breechblock, and as said breechblock reaches said firing position said spring locking-element springs back into said normally closed state thereby engaging said breechblock so as to lock said breechblock in said firing position.

5. The breech mechanism of claim 4, wherein said spring locking-element is configured with a plurality of longitudinal slots along a portion of a length of said spring locking-element, said slots thereby defining between, them, locking fingers that are connected to said spring locking-element at a first end, and free to spread substantially radially at a second end of said spring locking-element.

6. The breech mechanism of claim 5, further comprising engagement faces of said locking fingers configured at said second end of said spring locking-element, said engagement faces being configured such that as said breechblock is displaced from said ejecting and loading position toward said firing position, said breechblock engages said engagement faces thereby causing said locking fingers to spread radially so as to allow said breechblock to enter said spring locking-element such that said spring locking-element substantially circumscribes at least a portion of said breechblock.

7. The breech mechanism of claim 6, wherein said engagement faces form an interior surface of said spring locking-element, said engagement faces being configured so as to be inwardly convergent.

8. The breech mechanism of claim 7, further comprising a locking ridge deployed on said locking fingers, said locking ridge configured so as to engage said breechblock.

9. The breech mechanism of claim 8, wherein said breechblock is configured with said first end having a substantially radially enlarged portion, said enlarged portion terminating at said first end of said breechblock, said enlarged portion terminating at a second end in a locking shoulder, said locking shoulder configured to interlock with said locking ridge.

10. The breech mechanism of claim 9, wherein said locking shoulder substantially circumscribes said breechblock.

11. The breech mechanism of claim 9, wherein said releasing element is deployed so as to circumscribe at least a portion of a non-enlarged portion of said breechblock, said releasing element having an outside diameter at least equal to the outside diameter of said enlarged portion of said breechblock, said releasing element being displaceable in a direction substantially parallel to a length of said breechblock, said releasing element being displaceable between locking and releasing positions such that when said releasing element is displaced to said releasing position, said releasing element engages said engagement faces of said locking fingers thereby spreading said locking fingers radially so as to allow said displacement of said breechblock.

12. The breech mechanism of claim 1, wherein said breechblock is configured so as to be non-rotating.

13. The breech mechanism of claim 2, wherein said breechblock, said spring locking-element, and said releasing element are substantially cylindrical.

14. The breech mechanism of claim 1, wherein a longitudinal position of said spring locking-element within said breech housing is variable.

15. The breech mechanism of claim 14, wherein said position of said spring locking-element is varied by at least one spacer deployed adjacent to at least one end of said spring locking-element.

16. The breech mechanism of claim 2, wherein said displacement of said releasing element is actuated by rotation of a breechblock handle located adjacent to a second end of said breechblock.

17. The breech mechanism of claim 16, wherein an axis of said rotation of said breechblock handle is substantially perpendicular to a line of displacement of said breechblock.

18. The breech mechanism of claim 17, wherein a vector of displacement of said breechblock from said firing position to said ejection and loading position is parallel to a plane of rotation of said breechblock handle is parallel, such that said force applied to said handle rotates said handle thereby releasing said breechblock and said force then actuates said displacement of said breechblock.

19. The breech mechanism of claim 1, wherein said spring locking-element is configured so as to define head space of the firearm.

* * * * *